United States Patent [19]

Mishima

[11] Patent Number: 4,704,932

[45] Date of Patent: Nov. 10, 1987

[54] ELECTRONIC MUSICAL INSTRUMENT PRODUCING LEVEL-CONTROLLED RHYTHMIC TONES

[75] Inventor: Junichi Mishima, Hamamatsu, Japan

[73] Assignee: Nippon Gakki Seizo Kabushiki Kaisha, Hamamatsu, Japan

[21] Appl. No.: 920,147

[22] Filed: Oct. 16, 1986

[30] Foreign Application Priority Data

Oct. 21, 1985 [JP] Japan ..... 60-161165

[51] Int. Cl.[4] ..... G10H 1/22; G10H 1/42; G10H 1/46

[52] U.S. Cl. ..... 84/1.03; 84/1.27; 84/DIG. 2; 84/DIG. 12

[58] Field of Search ..... 84/1.03, 1.27, DIG. 2, 84/DIG. 12

[56] References Cited

U.S. PATENT DOCUMENTS 4,353,278 10/1982 Adachi et al. ..... 84/DIG. 2

4,499,807 2/1985 Ishida ..... 84/1.03

*Primary Examiner*—S. J. Witkowski

*Attorney, Agent, or Firm*—Spensley Horn Jubas & Lubitz

[57] ABSTRACT

An electronic musical instrument allows the performer to control tone volume of a rhythmic tone by a simple manipulation of keys of a keyboard. The electronic musical instrument comprises a rhythmic tone generator including a plurality of tone sources, to which a group of keys of the keyboard are assigned, respectively. Each of the tone sources generates a rhythmic tone when a corresponding one of the group of keys is depressed. When it is desired to give an accent to the rhythmic tone, a key adjacent the depressed tone source designating key is additionally depressed. This multiple key-depression is detected by a detection circuit. Tone volume of the rhythmic tone generated by the tone source is controlled in accordance with the detection of the multiple key-depression.

5 Claims, 5 Drawing Figures

ELECTRONIC MUSICAL INSTRUMENT PRODUCING LEVEL-CONTROLLED RHYTHMIC TONES

BACKGROUND OF THE INVENTION

1. Field of the Invention

The present invention relates generally to an electronic musical instrument, and more particularly to such an electronic musical instrument in which rhythmic tones can be programmed and/or produced in accordance with manipulation of keys of a keyboard.

2. Prior Art

There has been proposed an electronic musical instrument with a keyboard in which tone sources of rhythmic tones are selectively driven in accordance with manipulation of keys of the keyboard to produce rhythmic tones. In such conventional electronic musical instrument, a group of keys among the keys of the keyboard are manipulated to selectively designate the rhythmic tone sources, and a specific one of the keyboard keys or a specific switch is manipulated to give the rhythmic tone to be generated an accent (or stress). The group of keys can be selectively manipulated designating the rhythmic tone sources so that data representative of a rhythm pattern according to the key manipulation is stored in an associated memory. A rhythm may be played in real time by manipulating the group of keys for selectively designating the rhythmic tone sources (so-called "hand percussion" or "keyboard percussion").

With the conventional electronic musical instrument, however, since only one specific key is provided for giving an accent to each rhythmic tone in spite of the fact that the group of keys for designation of the rhythmic tone sources include a relatively large number of keys, two hands must be used when the key for designating a desired one of the rhythmic tone sources is disposed far apart from the specific key for giving an accent. Difficulty has therefore been encountered in playing a rhythm of a high tempo or a syncopated rhythm.

SUMMARY OF THE INVENTION

It is therefore an object of the present invention to provide an electronic musical instrument in which accentuation of each rhythmic tone generated can be controlled by a simple and easy operation.

According to an aspect of the present invention, there is provided an electronic musical instrument which comprises rhythmic tone signal forming means having a plurality of tone signal sources for respectively outputting tone signals which form a rhythmic tone signal; a plurality of switch means each for designating a respective one of the plurality of tone signal sources, each of the switch means outputting a tone source designating signal when manipulated; detection means responsive to the tone source designating signal from each of the plurality of switch means for detecting a simultaneous manipulation of more than one of the switch means to output a detection signal; signal selection means responsive to the detection signal for selectively outputting one of those tone source designating signals outputted from the switch means simultaneously manipulated, the signal selection means outputting the tone source designating signal from the manipulated switch means when the detection signal is not received, the tone source designating signal outputted from the signal selection means being supplied to a corresponding one of the tone signal sources for causing the tone signal to be outputted therefrom; and tone volume control means responsive to the detection signal for controlling a signal level of the rhythmic tone signal. The plurality of switch means can be constituted by a group of keys provided in a keyboard and switches operatively connected respectively to the group of keys.

DESCRIPTION OF THE PREFERRED EMBODIMENT OF THE INVENTION

Figure 1:
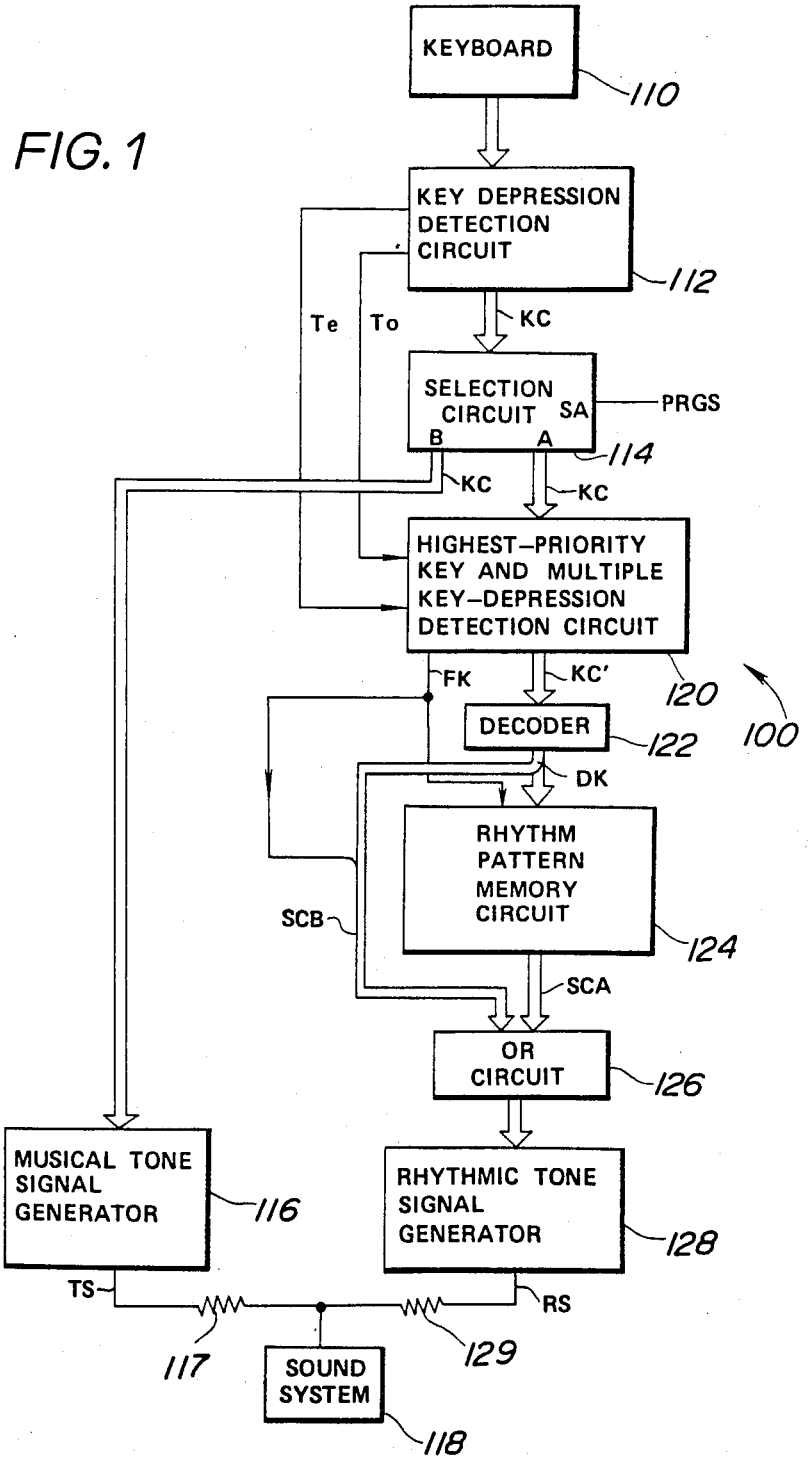
FIG. 1 is a block diagram of an electronic musical instrument 100 provided in accordance with the present invention.

Referring now to FIG. 1, there is shown an electronic musical instrument 100 provided in accordance with the present invention.

This electronic musical instrument 100 is arranged so as to operate selectively in one of two modes, namely, a rhythm sequence program mode and an automatic rhythm play mode. When the program mode is selected, data representative of a rhythm pattern can be stored into an associated memory in accordance with manipulations of keys of a keyboard 110. In this case, it is also possible to generate a rhythmic tone corresponding to each manipulated key, and if it is not necessary to store the rhythm pattern into the memory (i.e., in the case where step selection keys as later described are not operated), the performer can enjoy a play of rhythm through the keyboard 110 (a play of percussive instruments through the keyboard 110). It is not possible, however, to play a melody or the like on the keyboard 110.

On the other hand, when the play mode is selected, the stored rhythm pattern data are sequentially read from the memory and the rhythm is automatically played in accordance with the read rhythm pattern data. In this case, if desired, the performer can play a melody to the accompaniment of the automatically played rhythm.

The structure of the electronic musical instrument 100 will now be more fully described.

The keyboard 110 is of the conventional type which has a plurality of white and black keys arranged in a predetermined order. Each key of the keyboard 110 is provided with a key switch which closes when the corresponding key is depressed.

A key depression detection circuit 112 periodically scans the key switches of all the keys of the keyboard 110 to detect depression of any key, and outputs a key code KC representative of each depressed key. The key depression detection circuit 112 outputs a timing signal To immediately before beginning each scan of the keys and outputs another timing signal Te at the end of each scanning of the keys. Such key depression detection circuit is known in the art. The key code KC outputted from the key depression detection circuit 112 is supplied to an input terminal of a selection circuit 114.

The selection circuit 114 outputs the supplied key code KC to a musical tone signal generator 116 when a mode selection signal PRGS fed to a selection control terminal SA thereof is "0". This mode selection signal PRGS is rendered "1" when the program mode is selected, and is rendered "0" when the play mode is selected. When the mode selection signal PRGS is "1", the selection circuit 114 outputs the supplied key code KC to a highest-priority key and multiple key-depression detection circuit 120.

The musical tone signal generator 116 generates, in response to each key code KC supplied thereto, a tone signal TS corresponding to the depressed key represented by the key code KC, and outputs the tone signal TS through a resistor 117 to a sound system 118. The sound system 118 includes an amplifier and a loudspeaker (not shown) and produces a tone in accordance with the tone signal TS.

When only one of the keys is depressed on the keyboard 110, the highest-priority key and multiple key-depression detection circuit 120 outputs the key code KC representative of the depressed key as a key code KC' to a decoder 122. On the other hand, when more than one of the keys are depressed simultaneously on the keyboard 110, the highest-priority key and multiple key-depression detection circuit 120 outputs the key code KC corresponding to the highest-pitch key (could be the lowest-pitch key) among the simultaneously depressed keys as the key code KC'. In the latter case, the highest-priority key and multiple key-depression detection circuit 120 outputs a multiple key-depression detection signal FK together with the key code KC'. The detailed structure of the highest-priority key and multiple key-depression detection circuit 120 will be described later.

The decoder 122 decodes the key code KC' and outputs the decode result DK in the form of n-bit data, wherein the one of the n bits corresponding to the depressed key represented by the key code KC' is rendered "1". The bit of the n-bit output data DK which is in the "1" state is used as a tone source designation signal as later described. The data DK from the decoder 122 and the aforesaid multiple key-depression detection signal FK are supplied to a rhythm pattern memory circuit 124.

The rhythm pattern memory circuit 124 comprises the above-mentioned memory for storing data representative of a rhythm pattern. In the program mode, the rhythm pattern data are stored into the memory. On the other hand, in the play mode, each of the stored rhythm pattern data is read from the memory and outputted as tone generation control data SCA to an OR circuit 126. The rhythm pattern memory circuit 124 will be more fully described later.

The OR circuit 126 receives the tone generation control data SCA from the rhythm pattern memory circuit 124 and also receives tone generation control data SCB which include the data DK from the decoder 122 and the multiple key-depression detection signal FK from the highest-priority key and multiple key-depression detection circuit 120. The OR circuit 126 logically adds the two data SCA and SCB together and outputs the addition result to a rhythmic tone signal generator 128. Actually however, only one of the two data SCA and SCB is supplied to the OR circuit 126 at a time, so that the rhythmic tone signal generator 128 receives the data SCA or SCB.

The rhythmic tone signal generator 128 comprises n sets of rhythmic tone signal sources which are assigned respectively to n pieces of key among the keys of the keyboard 110 and correspond respectively, for example, to a bass drum, cymbals, . . . and maracas. The rhythmic tone signal generator 128 further comprises n sets of tone volume control circuits each for controlling a signal level of an output signal of a respective one of the rhythmic tone signal sources. The rhythmic tone signal generator 128 generates a rhythmic tone signal RS in accordance with the data SCA or SCB and outputs it through a resistor 129 to the sound system 118, whereby a rhythmic tone is outputted from the sound system 118.

Figure 2:
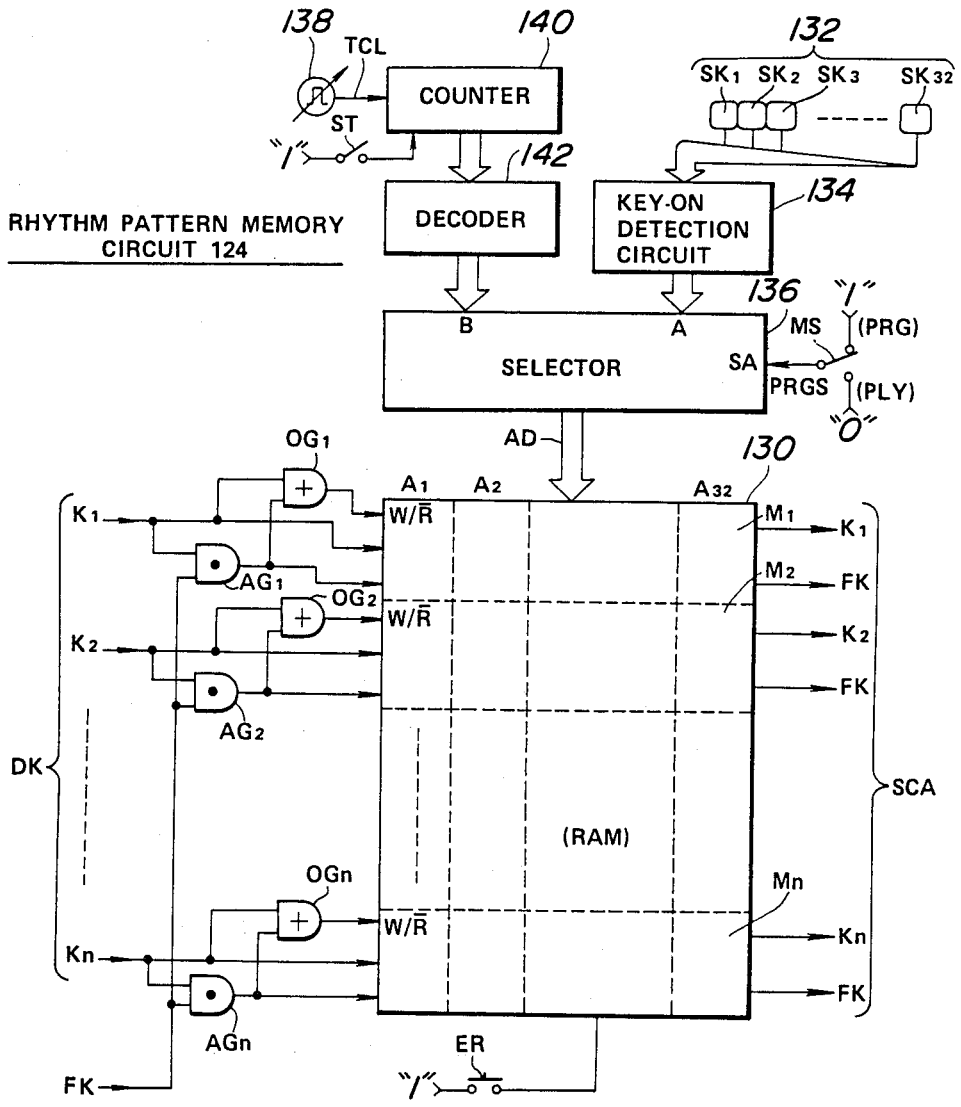
FIG. 2 is a logic block diagram of the rhythm pattern memory circuit 124 of the electronic musical instrument 100 of FIG. 1.

The structure of the rhythm pattern memory circuit 124 will now be more fully described with reference to FIG. 2.

The rhythm pattern memory circuit 124 comprises a random access memory (RAM) 130 composed of n pieces of memory portion $M_1$ to $M_n$ each having 32 addresses $A_1$ to $A_{32}$, and is capable of storing data representative of a rhythm pattern for two measures.

The data DK fed from the decoder 122 to this rhythm pattern memory circuit 124 includes, as described above, n pieces of tone source designation signal identified by reference numerals $K_1$ to $K_n$ which correspond respectively to the aforesaid n keys. Each of the tone source designation signals $K_1$ to $K_n$ serves as a signal for commanding a respective one of the rhythmic tone signal sources in the rhythmic tone signal generator 128 to generate the corresponding rhythmic tone signal. The multiple key-depression detection signal FK fed from the highest-priority key and multiple key-depression detection circuit 120 to this rhythm pattern memory circuit 124 serves as a signal for controlling a signal level of the generated rhythmic tone signal.

The tone source designation signals $K_1$ to $K_n$ represented by the bits of the data DK are supplied to first data input terminals of the memory portions $M_1$ to $M_n$ as well as to first input terminals of AND gates $AG_1$ to $AG_n$, respectively. The tone source designation signals $K_1$ to $K_n$ are also supplied to first input terminals of OR gates $OG_1$ to $OG_n$, respectively. The multiple key-depression detection signal FK is supplied to second input terminals of the AND gates $AG_1$ to $AG_n$.

Each of the AND gates $AG_1$ to $AG_n$ feeds the multiple key-depression detection signal FK, which is "1" when more than one key are depressed and is "0" when only one key is depressed, to a second data input terminal of a corresponding one of the memory portions $M_1$ to $M_n$ when a corresponding one of the tone source designation signals $K_1$ to $K_n$ is "1". Each of the output signals of the AND gates $AG_1$ to $AG_n$ is also supplied to a second input terminal of a respective one of the OR gates $OG_1$ to $OG_n$.

Output signals of the OR gates $OG_1$ to $OG_n$ are supplied to read/write control terminals of the memory portions $M_1$ to $M_n$ as read/write control signals $W/\overline{R}$, respectively. Each of the memory portions $M_1$ to $M_n$ is brought into a write mode when a corresponding one of the read/write control signals $W/\overline{R}$ outputted from the OR gates $OG_1$ to $OG_n$ is "1". In other words, each of the memory portions $M_1$ to $M_n$ is in a read mode when a corresponding one of the tone source designation signals $K_1$ to $K_n$ is "0", and is held in the write mode during the time when a corresponding one of the tone source designation signals $K_1$ to $K_n$ is "1".

An erasing switch ER is provided for selectively erasing contents of the RAM 130. More specifically, when the erasing switch ER is closed, data contained in a selected one of the addresses $A_1$ to $A_{32}$ of the memory portion which is in the write mode is erased.

Step selection key unit 132 includes 32 pieces of step selection key $SK_1$ to $SK_{32}$ each corresponding to a respective one of 32 steps or time slots constituting two measures. More specifically, two consecutive measures are divided into 32 steps of identical time length, and the step selection keys $SK_1$ to $SK_{32}$ are assigned to the first to thirty second steps, respectively. In this case, each step is equivalent in time length to a sixteenth note.

A depression of any one of the step selection keys $SK_1$ to $SK_{32}$ is detected by a key-on detection circuit 134, and a key-on signal representative of each depression of selection key is supplied to a data input terminal A of a selector 136.

A tempo clock generator 138 generates a tempo clock signal TCL which determines a tempo of a rhythm to be played by this electronic musical instrument 100. The frequency of the tempo clock signal TCL can be adjusted by the performer. The tempo clock signal TCL outputted from the tempo clock generator 138 is supplied to a counter 140.

The counter 140 is normally reset to zero, and is enabled to count pulses of the tempo clock signal TCL when a play start switch ST is closed. The count value of the pulses of the tempo clock signal TCL is supplied from the counter 140 to a decoder 142.

The decoder 142 decodes the count value fed from the counter 140 and supplies the decode result to a data input terminal B of the selector 136.

The selector 136 outputs the key-on signal fed from the key-on detection circuit 134 as address data AD when a mode selection switch MS is in a position for the program mode PRG to supply the mode selection signal PRGS of "1" to a selection control terminal SA of the selector 136. On the other hand, when the mode selection switch MS is turned to another position for the play mode PLY to render the mode selection signal PRGS to the selection control terminal SA "0", the selector 136 outputs the data from the decoder 142 as the address data AD. The mode selection switch MS may be arranged such that it is automatically brought into the position for the play mode PLY when the play start switch ST is closed.

The address data AD outputted from the selector 136 is supplied to address input terminals of the RAM 130 to select those addresses which the rhythm pattern data are to be written into or to be read from. More specifically, the address data AD selects one of the addresses $A_1$ to $A_{32}$ of each of the memory portions $M_1$ to $M_{32}$. In the program mode PRG, the one of the addresses $A_1$ to $A_{32}$ of each of the memory portions $M_1$ to $M_{32}$ which corresponds to the depressed one of the step selection keys $SK_1$ to $SK_{32}$ is designated by the address data AD. In the play mode PLY, the addresses $A_1$ to $A_{32}$ of each of the memory portions $M_1$ to $M_{32}$ are sequentially and cyclicly designated by the address data AD in accordance with the counting operation of the counter 140.

The procedure of programming a rhythm pattern will now be briefly described.

At first, the mode selection switch MS is operated to select the program mode PRG. Then, one of the step selection keys $SK_1$ to $SK_{32}$ which corresponds to a desired one of the 32 steps is depressed. For example, where the second step is to be designated, the step key $SK_2$ is depressed, in which case the address $A_2$ is selected. In the case where a cymbals tone is to be generated at the step designated by the step selection key $SK_2$, that key of the keyboard 110 which corresponds to the tone source designation signal $K_2$ is depressed. In this case, if the cymbals tone must be sounded strongly or loudly, at least one of those keys of the keyboard 110 which is disposed on the left-hand side of and adjacent to the key corresponding to the signal $K_2$ is additionally depressed. When such operation of keys is performed, data composed of two "1" bits representative respectively of the tone source designation signal $K_2$ in the "1" state and the multiple key-depression detection signal FK in the "1" state is stored into the address $A_2$ of the memory portion $M_2$. In this case, if only the key corresponding to the signal $K_2$ is depressed, data composed of a "1" bit and a "0" bit representative respectively of the tone source designation signal $K_2$ in the "1" state and the multiple key-depression detection signal FK in the "0" state is stored into the address $A_2$ of the memory portion $M_2$. If it is desired that a drum tone be generated together with the cymbals tone at the second step, the key corresponding to the tone source of a drum tone is depressed after the storing of the data relating to the cymbals tone has been completed. In this case, if the drum tone is to be given an accent, another key is depressed simultaneously with the key corresponding to the drum tone.

In a similar manner, designation of each desired rhythmic tone source and a tone level of the rhythmic tone generated thereby is performed with respect to each of the 32 steps, so that data representative of a rhythm pattern for two measures are stored into the RAM 130.

After the storing of the data representative of the rhythm pattern has been completed, the mode selection switch MS is operated to cause this instrument 100 to operate in the play mode PLY.

In this play mode, the sequential selection of the addresses of the RAM 130 is performed from the address $A_1$ to the address $A_{32}$ in accordance with the counting of the tempo clock TCL by the counter 140. When the address $A_{32}$ is selected, the address $A_1$ is selected next. Such sequential selection of address is repeatedly carried out. As a result, during the time when the address $A_1$ is selected in the first cycle of reading of the rhythm pattern data from the RAM 130, the data SCA representative of the states of the tone source designation signals $K_1$ to $K_n$ and the states of the accompanying multiple key-depression detection signals FK is read from the addresses $A_1$ of the memory portions $M_1$ to $M_n$. The similar reading operation is performed with respect to each of the addresses $A_2$ to $A_{32}$. The same operation is performed for each cycle after the first cycle to repeatedly read from the RAM 130 the rhythm pattern data for the two measures.

Figure 3:
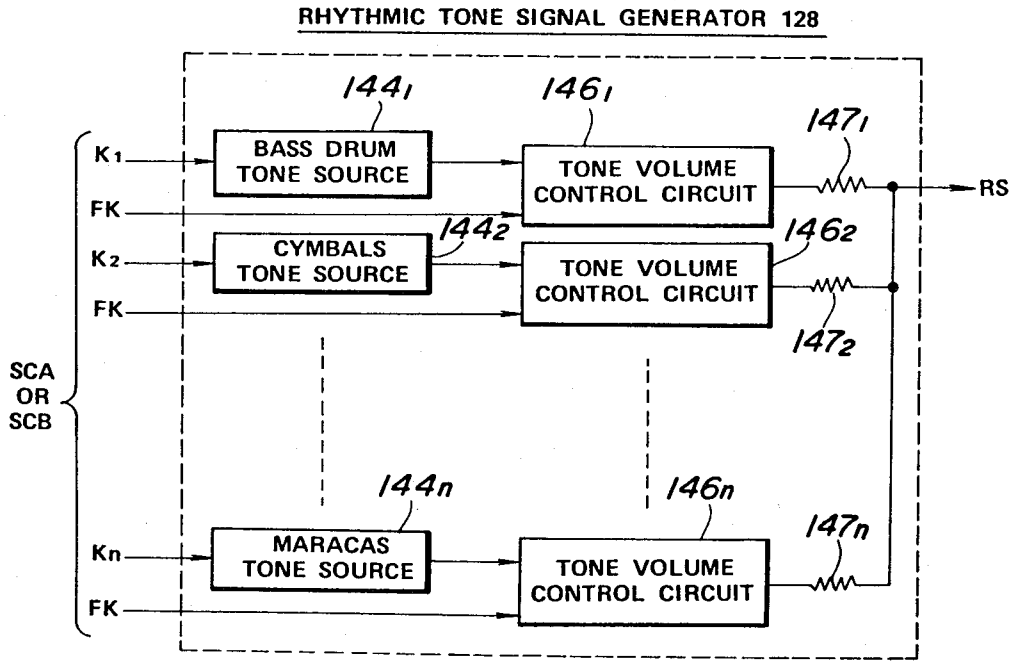
FIG. 3 is a detailed block diagram of the rhythmic tone signal generator 128 of the electronic musical instrument 100 of FIG. 100.

The rhythmic tone signal generator 128 will now be more fully described with reference to FIG. 3.

The rhythmic tone signal generator 128 is supplied, from the OR circuit 126, with the tone generation control data SCA or the tone generation control data SCB each of which includes the tone source designation signals $K_1$ to $K_n$ and the multiple key-depression detection signals FK accompanied respectively therewith. The tone generation control data SCA is supplied to the rhythmic tone signal generator 128 when the play mode PLY is selected to read the rhythm pattern data from the RAM 130, while the tone generation control data SCB is supplied to the rhythmic tone signal generator 128 when the program mode PRG is selected to store a rhythm pattern data into the RAM 130 or to play a rhythm of percussive tones on the keyboard 110.

The rhythmic tone signal generator 128 comprises n pieces of tone source $\mathbf{144}_1$, $\mathbf{144}_2$, . . . and $\mathbf{144}_n$ for generating a bass drum tone signal, a cymbals tone signal, . . . and a maracas tone signal, respectively. The tone source designation signals $K_1$, $K_2$, . . . and Kn are supplied to the bass drum tone source $\mathbf{144}_1$, cymbals tone source $\mathbf{144}_2$, . . . and maracas tone source $\mathbf{144}_n$, respectively. Each of the tone sources $\mathbf{144}_1$ to $\mathbf{144}_n$ generates a rhythmic tone signal when a corresponding one of the tone source designation signals $K_1$ to $K_n$ is rendered "1".

The rhythmic tone signal generator 128 further comprises n pieces tone volume control circuit $\mathbf{146}_1$, $\mathbf{146}_2$, . . . and $\mathbf{146}_n$. The multiple key-depression detection signals FK, contained in the tone generation control data SCA and read respectively from the memory portions $M_1$ to $M_n$, are supplied to these tone volume control circuits $\mathbf{146}_1$ to $\mathbf{146}_n$, respectively. The multiple key-depression detection signal FK contained in the tone generation control data SCB is supplied to all the tone volume control circuit $\mathbf{146}_1$ to $\mathbf{146}_n$.

Each of the tone volume control circuits $\mathbf{146}_1$ to $\mathbf{146}_n$ receives a respective one of the output signals of the tone sources $\mathbf{144}_1$ to $\mathbf{144}_n$ and renders a signal level of the received signal high when the supplied multiple key-depression detection signal FK is "1" and low when "0". Thus, each of the tone volume control circuits $\mathbf{146}_1$ to $\mathbf{146}_n$ selectively gives an accent to a respective one of the rhythmic tones constituting the rhythm to be played. More specifically, in the play mode PLY, when the tone source designation signals $K_1$ and $K_2$ are both "1" with the two multiple key-depression detection signals FK accompanied with the signals $K_1$ and $K_2$ being "1" and "0", respectively, the signal level of the bass drum tone signal is rendered high while that of the cymbals tone signal is rendered low. In this case, however, if the multiple key-depression detection signals FK accompanied with the signals $K_1$ and $K_2$ are rendered both "0" at another timing, the signal levels of the bass drum and cymbals tone signals are both rendered low. On the other hand, in the program mode PRG, the tone volume control circuits $\mathbf{146}_1$ to $\mathbf{146}_n$ respectively control the signal levels of the output signals from the tone sources $\mathbf{144}_1$ to $\mathbf{144}_n$ in accordance with the multiple key-depression detection signal FK contained in the tone generation control data SCB. In this case, however, only one of the tone source designation signals $K_1$ to $K_2$ is rendered "1" at a time. Therefore, when the tone source designation signal $K_1$ is rendered "1" with the multiple key-depression signal FK being "1", only the signal level of the bass drum tone signal is rendered high. And, when the tone source designation signal $K_2$ is rendered "1" with the multiple key-depression signal FK being "0", only the signal level of the cymbals tone signal is rendered low.

Output signals of the tone volume control circuits $\mathbf{146}_1$ to $\mathbf{146}_n$ are mixed with one another by resistors $\mathbf{147}_1$ to $\mathbf{147}_n$ connected respectively to output terminals of the tone volume control circuits $\mathbf{146}_1$ to $\mathbf{146}_n$. The mixed signal is supplied to the sound system (FIG. 1) as the tone signal RS.

With the rhythm pattern memory circuit 124 (FIG. 2), all the rhythm pattern data (for example, for two measures) are manually determined and stored in the RAM 130. However, the rhythm pattern memory circuit 124 may be modified such that rhythm pattern data (for example, for two measures) are transferred to the RAM 130 from a recording medium or data storage means (not shown) and that the rhythm pattern data thus stored into the RAM 130 are then manually modified.

Figure 4:
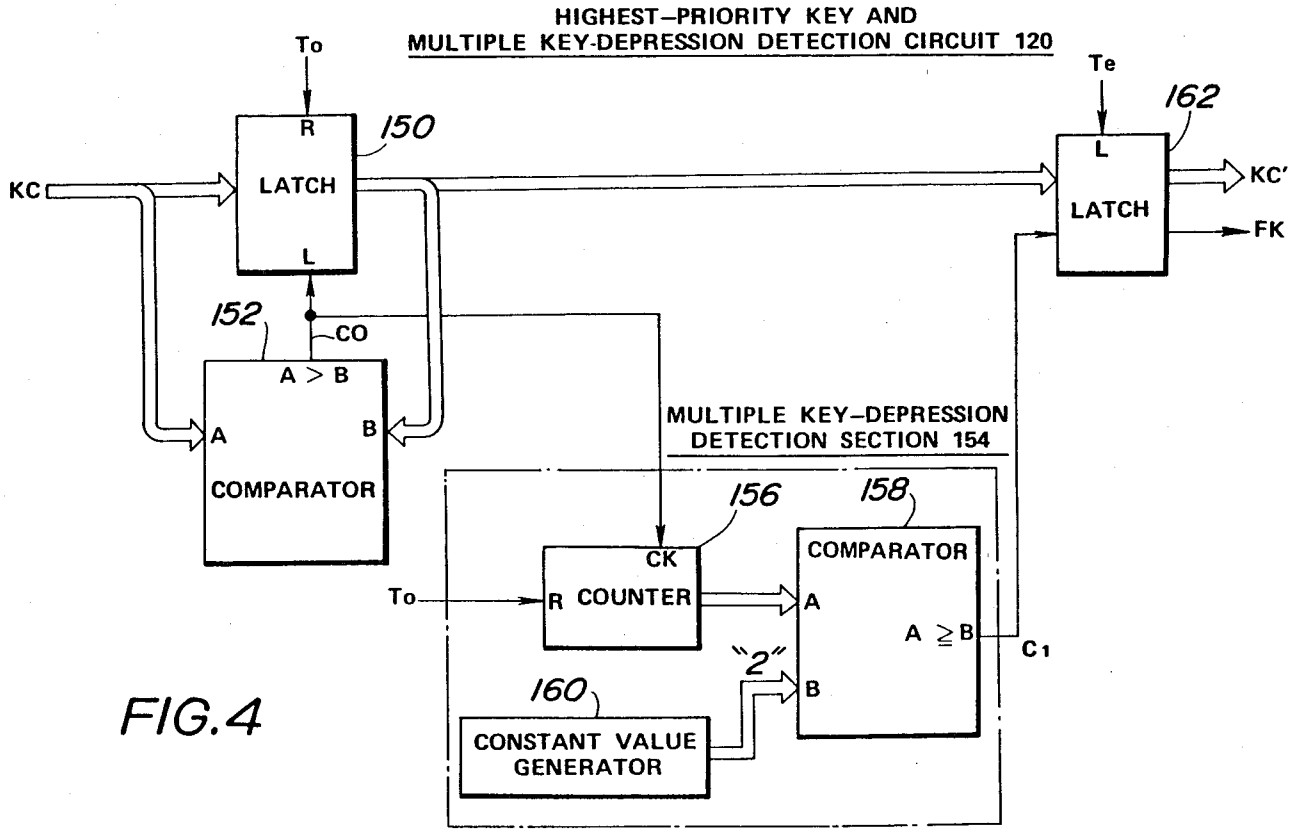
FIG. 4 is a detailed block diagram of the highest-priority key and multiple key-depression detection circuit 124 of the electronic musical instrument 100 of FIG. 1.

The highest-priority key and multiple key-depression detection circuit 120 will now be more fully described with reference to FIG. 4.

The key code KC fed from the selection circuit 114 (FIG. 1) is supplied to a data input terminal of a latch 150 and to an input terminal A of a comparator 152. The latch 150 is reset to "0" when the timing signal To of "1" is supplied to a reset terminal R thereof, and stores the key code KC when a "1" signal is applied to a load terminal L thereof.

The comparator 152 compares the key code KC fed to the input terminal A with an output of the latch 150 fed to another input terminal B thereof, and outputs a comparison result signal Co of "1" when the key code KC fed to the input terminal A is greater than the output of the latch 150 fed to the input terminal B. The signal Co is supplied to the load terminal L of the latch 150 and to a clock terminal CK of a counter 156 provided in a multiple key-depression detection section 154.

Since the key depression detection circuit 112 (FIG. 1) scans the keys of the keyboard 110 from the lowest pitch key to the highest pitch key, the latch 150 sequentially receives the key codes KC of the simultaneously depressed keys from the lower pitch one. Both of the latch 150 and the counter 156 are reset to "0" each time the timing signal To is rendered "1" immediately before the beginning of each scan of the keyboard 110.

When the key code KC of the lower pitch one of the simultaneously depressed keys (it is assumed here that this key code KC is $KC_1$) is fed from the selection circuit 114 (FIG. 1), the comparator 152 compares the key code $KC_1$ with "0" initially stored in the latch 150 and outputs the comparison result signal Co of "1", so that the latch 150 stores the key code $KC_1$ thereinto. Then, when the key code KC of the higher pitch one of the simultaneously depressed keys (it is assumed that this key code KC is $KC_2$) is supplied, the comparator 152 compares the key code $KC_2$ with the key code $KC_1$ and outputs the comparison result signal Co of "1", so that the key code $KC_2$ is stored into the latch 150. As a result, the key code KC of the highest pitch one of the simultaneously depressed keys is left stored in the latch 150. When only one of the keys is depressed, the key code KC of the depressed key is held in the latch 150.

The counter 156 of the multiple key-depression detection section 154 counts the comparison result signal Co from the comparator 152. The number of outputs of the comparison result signal Co are equal to the number of depressed keys of the keyboard 110, so that the counter 156 outputs data representative of the number of depressed keys to an input terminal A of a comparator 158. Another input terminal B of the comparator 158 is supplied with data representative of "2" generated by a constant value generator 160.

The comparator 158 compares the output of the counter 156 with "2" outputted from the constant value generator 160, and outputs a comparison result signal $C_1$ which is "0" when the output of the counter 156 is less than "2" (i.e., when only one key is depressed), and is "1" when the output of the counter 156 is not less than "2" (i.e., when more than one key is simultaneously depressed). The comparison result signal $C_1$ outputted from the comparator 158 is supplied together with the key code outputted from the latch 150 to input terminals of a latch 162.

The latch 162 stores the key code and the comparison result signal $C_1$ when a load terminal L thereof is supplied with the timing signal Te which is rendered "1" each time the scan of the keys of the keyboard 110 is finished. When more than one key is simultaneously depressed, the latch 162 stores the key code fed from the latch 150 and representing the highest pitch one of the depressed keys together with the comparison result signal $C_1$ of "1" from the comparator 158. On the other hand, when only one key is depressed, the latch 162 stores the key code of the depressed key together with the comparison result signal $C_1$ of "0". The latch 162 outputs the stored key code as the key code KC' and also outputs the stored comparison result signal $C_1$ as the multiple key-depression detection signal FK.

Figure 5:
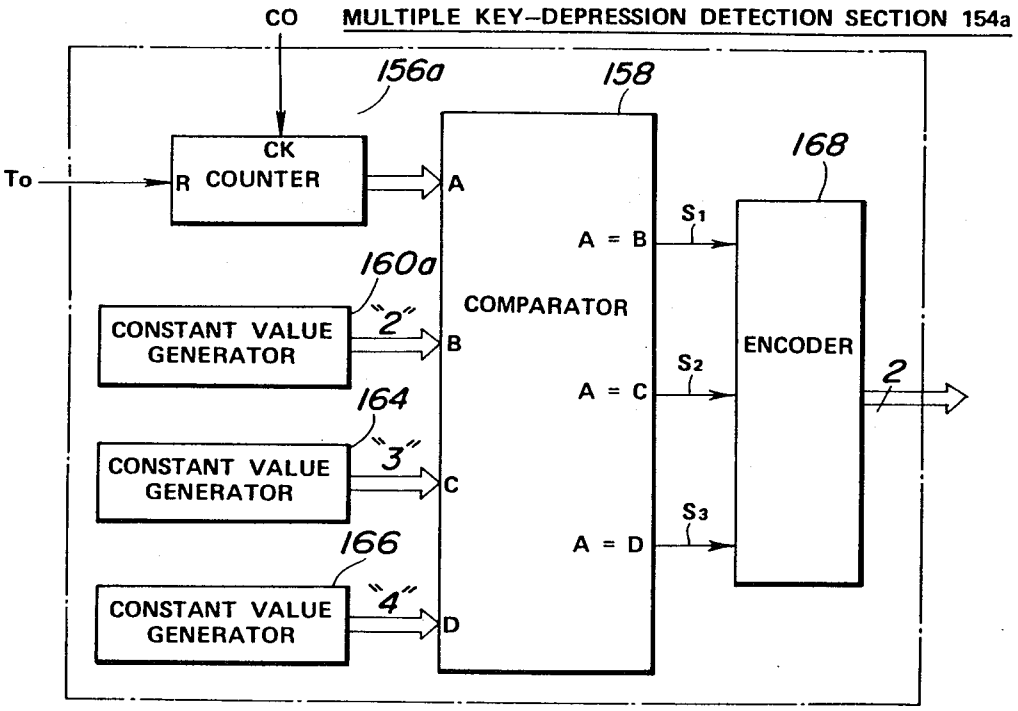
FIG. 5 is a block diagram of a modified form of the multiple key-depression detection section 154 of the multiple key-depression detection circuit 124 of FIG. 4.

A modified form of the multiple key-depression detection section 154 will now be described with reference to FIG. 5.

The modified multiple key-depression detection section **154*a* has such a construction that a code signal representative of the number of simultaneously depressed keys is produced to enable a multi-level tone volume control of each rhythmic tone. The multiple key-depression detection section 154*a* comprises a counter 156*a* and a constant value generator 160*a* which are similar in construction respectively to those shown in FIG. 4. The multiple key-depression detection section 154*a* further comprises two constant value generators 164 and 166 for respectively outputting data representative of "3" and "4". Outputs of the counter 156*a* and the constant value generators 160*a*, 164 and 166 are supplied respectively to input terminals A, B, C and D of a comparator 158. The comparator 158 outputs a signal $S_1$ of "1" from an output terminal A=B thereof when the output of the counter 156*a* is equal to "2" (i.e., when two keys are simultaneously depressed), outputs a signal $S_2$ of "1" from an output terminal A=C thereof when the output of the counter 156*a* is equal to "3" (i.e., when three keys are simultaneously depressed), and outputs a signal $S_3$ of "1" from an output terminal A=D thereof when the output of the counter 156*a* is equal to "4" (i.e., when four keys are simultaneously depressed). When the output of the counter 156*a* is less than "2" (i.e., when only one key is depressed), the signals $S_1$, $S_2$ and $S_3$ are all "0". The signals $S_1$ to $S_3$ are supplied to an encoder 168** which in turn converts the signals $S_1$ to $S_3$ into a two-bit binary code signal.

The output signal of the encoder 168 is outputted from the multiple key-depression detection circuit 120 (FIG. 4) through the latch 162 as a two-bit multiple key-depression detection signal FK. It is evident that the latch 162 (FIG. 4), the AND gates $AG_1$ to $AG_n$ (FIG. 2), the memory portions $M_1$ to $M_n$ (FIG. 2) and the tone volume control circuits $\mathbf{146}_1$ to $\mathbf{146}_n$ (FIG. 3) must be modified to process the two-bit multiple key-depression detection signal FK. By the use of such multiple key-depression detection signal FK in the circuit shown in FIG. 2, one of four levels of tone volume (for example, mezzo forte (mf), forte (f), fortissimo (ff) and fortississimo (fff)) can be selectively designated with respect to each of the tone source designation signals $K_1$ to $K_n$ during the programming of a rhythm pattern. And, each of the tone volume control circuits $\mathbf{146}_1$ to $\mathbf{146}_n$ shown in FIG. 3 can perform a four-level tone volume control to generate the corresponding rhythmic tone signal at one of the four levels, for example, of (mf), (f), (ff) and (fff).

As described above, with the electronic musical instrument according to the present invention, tone volume of a rhythmic tone can be controlled by depressing at least one key additionally to the key designating the rhythmic tone.

What is claimed is:

1. An electronic musical instrument comprising:

rhythmic tone signal forming means having a plurality of tone signal sources for respectively outputting tone signals which form a rhythmic tone signal;

a plurality of switch means each for designating a respective one of said plurality of tone signal sources, each of said switch means outputting a tone source designating signal when manipulated;

detection means coupled to said plurality of switch means for detecting a simultaneous manipulation of more than one of said switch means to output a detection signal;

signal selection means responsive to said detection signal for selectively outputting one of those tone source designating signals outputted from the switch means simultaneously manipulated, said signal selection means outputting the tone source designating signal from the manipulated switch means when said detection signal is not received, the tone source designating signal outputted from said signal selection means driving a corresponding one of said tone signal sources for causing the tone signal to be outputted therefrom; and tone volume control means responsive to said detection signal for controlling a signal level of said rhythmic tone signal.

2. An electronic musical instrument according to claim 1, wherein said plurality of switch means comprise a plurality of musical keys arranged in accordance with a musical scale and a plurality of switches operatively connected respectively to said musical keys for outputting the tone source designating signals, the tone source designating signal outputted from said signal selection means when at least two of said musical keys are simultaneously depressed corresponding to the musical key of the highest tone pitch among said simultaneously depressed musical keys.

3. An electronic musical instrument according to claim 1, wherein said plurality of switch means comprise a plurality of musical keys arranged in accordance with a musical scale and a plurality of switches operatively connected respectively to said musical keys for outputting the tone source designating signals, the tone source designating signal outputted from said signal selection means when at least two of said musical keys are simultaneously depressed corresponding to the musical key of the lowest tone pitch among said simultaneously depressed musical keys.

4. An electronic musical instrument according to claim 1, wherein said tone volume control means controls the signal level of said rhythmic tone signal in such a manner that the signal level is selected from a predetermined number of different signal levels in accordance with said detection signal.

5. An electronic musical instrument according to claim 4, wherein said detection signal represents the number of those switch means simultaneously manipulated, said tone volume control means controlling the signal level of said rhythmic tone signal so that the selection of the signal level is performed in accordance with the number of said simultaneously manipulated switch means.

* * * * *